US006361089B1

(12) United States Patent
Parker

(10) Patent No.: US 6,361,089 B1
(45) Date of Patent: Mar. 26, 2002

(54) ADAPTABLE LOW-POWER ELECTRONIC LOCKING MECHANISM

(75) Inventor: Bruce Parker, Woodside, CA (US)

(73) Assignee: Atlantes Services, Inc., Menlo Park, CA (US)

( * ) Notice: Subject to any disclaimer, the term of this patent is extended or adjusted under 35 U.S.C. 154(b) by 0 days.

(21) Appl. No.: 09/596,333

(22) Filed: Jun. 16, 2000

(51) Int. Cl.[7] ..... E05C 3/04
(52) U.S. Cl. ..... 292/210; 292/DIG. 23
(58) Field of Search ..... 292/201, 210, 292/292, DIG. 23

(56) References Cited

U.S. PATENT DOCUMENTS 4,219,227 A * 8/1980 Grabner et al. ..... 292/216
5,411,302 A * 5/1995 Shimada ..... 292/201
6,003,910 A * 12/1999 Dupont et al. ..... 292/201
6,092,404 A * 7/2000 Chhatwal ..... 70/278.1
6,145,354 A * 11/2000 Kondo et al. ..... 70/279.1
6,178,791 B1 * 1/2001 Hill et al. ..... 70/276

* cited by examiner

*Primary Examiner*—Christopher P. Schwartz
(74) *Attorney, Agent, or Firm*—Blakely Sokoloff Taylor & Zafman LLP

(57) ABSTRACT

An electronic locking mechanism comprises a first rod and a second rod. The second rod secures to the first rod by a cam wafer, which is attached to the second rod. A locking and unlocking mechanism secures the cam wafer to the first rod and releases the cam wafer from the first rod via an electrical solenoid.

18 Claims, 5 Drawing Sheets

ADAPTABLE LOW-POWER ELECTRONIC LOCKING MECHANISM

FIELD OF THE INVENTION

The present invention relates generally to locking mechanisms and, more particularly, to an electronic locking mechanism adaptable to fit enclosures of varying dimensions, while maintaining minimal power consumption.

BACKGROUND OF THE INVENTION

There are currently many different ways to lock things. One of the most common ways is the key locking mechanism. This type of mechanism is relatively secure and tamper proof. However, it is difficult to re-key a key lock to work with a different key if the original key is lost or stolen. Key locks can also be picked. In addition, it is sometimes inconvenient to keep a key.

Manual and electronic combination locking mechanisms provide many advantages. People may forget the combination, but at least they do not have to keep a key. The problem with manual combination locks such as those found on safes, vaults, lockers, and other enclosures, however, is that parts of the actual locking mechanism are often exposed and thus subject to tampering. In addition, mechanical combination locks require machining to high tolerances to avoid manipulation attacks.

While electronic combination locks are generally not exposed, they have other disadvantages. Electronic locks must keep the strike retracted until the user opens the lock, thus using large amounts of power. Another problem associated with electronic locks is that the strike operation can time out, thus forcing re-entry of the key. If one-time keys are used, access can be denied if the user is slow.

Another disadvantage of both key and combination locking mechanisms is their inability to accommodate enclosures of varying dimensions without having to alter the basic operation of the locking mechanism or having to use multiple locks for long doors.

Therefore, there is a need for an electronic locking mechanism that draws little power and that is adaptable to accommodate a broad range of enclosures.

SUMMARY OF THE INVENTION

One embodiment of the present invention provides an improved electronic locking mechanism that requires little power during operation and that is readily adaptable to fit enclosures of varying sizes without having to change the operation of the locking mechanism. The locking mechanism may be adapted to use two rods, a first and a second. The first rod may be attached to one side (i.e., a fixed portion) of an enclosure. The second rod may be attached to the door or lid (i.e., a movable) side of the enclosure. The first and second rod can be cut to the length necessary to fit the enclosure. Attached to one of the rods, preferably the second rod, are one or more cam wafers which are configured to engage to the first rod to lock the mechanism.

The locking mechanism itself is solenoid driven and can be secured to any one of the cam wafers in order to hold the lock in place. The solenoid is spring actuated and is powered by a battery or some other source of electricity. In the preferred embodiment, the electricity source is located in a module external from the locking mechanism. When the correct combination code is entered through a keypad and electronic controller, the controller energizes the solenoid just long enough for the solenoid to lift the pawl arm. When the pawl arm is lifted, no other force acts on the cam wafer in the locking mechanism. Because of the action of a torsion spring, which is coiled around the second rod with potential energy, when the force of the pawl arm is released from the cam wafer the second rod rotates and the cam wafer rotates and disengages from the first rod.

To lock the mechanism, the user manually pushes on the door or lid of the enclosure. The first rod contacts the cam wafer and, as the user pushes the door or lid shut, the second rod rotates and the cam wafer rotates. An aperture in the cam wafer slips behind a portion of the pawl arm, which comes down like a clamp and locks it in place.

BRIEF DESCRIPTION OF THE DRAWINGS

The present invention is illustrated by way of example, and not limitation, in the figures of the accompanying drawings in which like reference numerals refer to similar elements and in which.

DETAILED DESCRIPTION

Throughout the following description specific details are set forth in order to provide a more thorough understanding of the invention. However, the invention may be practiced without these particulars. In other instances, well known elements have not been shown or described in detail to avoid unnecessarily obscuring the present invention. Accordingly, the specification and drawings are to be regarded in an illustrative, rather than a restrictive, sense.

Figure 1:
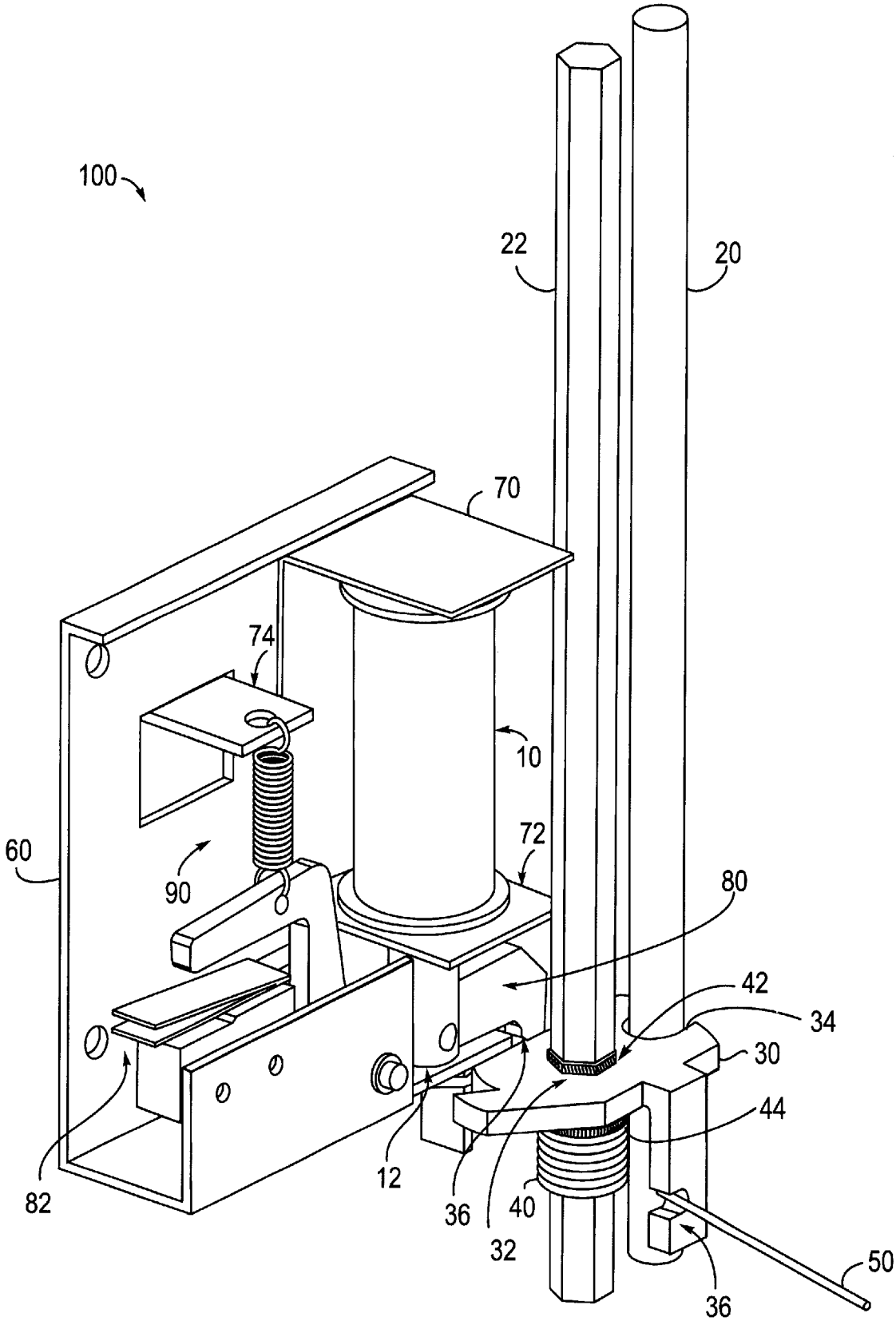
FIG. 1 is a perspective view of the locking mechanism shown in the locked position in accordance with one embodiment of the present invention.

Referring now to FIG. 1, there is shown a perspective view of an adaptable electronic locking mechanism configured in accordance with one embodiment of the present invention. The locking mechanism 100 includes a first rod 20 and a second rod 22. The first rod 20 is a round rod and is attached to one side of an enclosure. The second rod 22 is a hexagonal rod and is attached to the door or lid side of the enclosure. The first rod 20 and second rod 22 are cut to the length necessary to fit the enclosure. Note, in this example the rods have the cross-sectional shapes recited above, but this is not critical to the present invention. Rods of any convenient cross-sectional shape may be used so long as the overall functionality of the locking mechanism remains substantially similar to that described below.

Attached to the second rod 22 is a cam wafer 30 which is configured to engage to the first rod 20 to lock the mechanism. The cam wafer 30 includes a thru-hole 32 through which the second rod 22 may pass. In this way the cam wafer 30 may be secured to the second rod 22. A u-shaped hole 34 in the cam wafer 30 engages the first rod 20 and is fitted to the diameter of the first rod 20. A clip on the cam wafer (not shown in this view) extends below the horizontal plane of the body of the cam wafer 30 and engages the torsion spring 40 which is coiled around the second rod 22 below the cam wafer 30. A portion of the cam wafer 30 may bend downward in a right angle to the main horizontal plane of the cam wafer 30. The bent portion of the cam wafer 30 may have a u-shaped hole 36 to engage the end of the torsion spring 40 at the base of the locking mechanism 100 and thus provide a self-opening tension for the door.

Circumferential or semi-circumferential grooves (not shown in this view) may be cut into the second rod 22 directly above and below the cam wafer 30. These grooves can accommodate an upper e-clip 42 and a lower e-clip 44, which in this example are dome-shaped wafers made of spring steel. The domed portion of the upper e-clip 42 and the lower e-clip 44 is inserted laterally into the respective grooves on the second rod 22 thereby securing the upper e-clip 42 and the lower e-clip 44 to the second rod 22. The cam wafer 30 is held firmly in place between the upper e-clip 42 and the lower e-clip 44 and is thus prevented from moving up or down the second rod 22. Similarly, other shapes for the e-clips 42 and 44 may be used. However, regardless of the configuration of the e-clips 42 and 44, it is desirable to include some method such as press-fittings or set screws to prevent displacement of the cam wafer 30 along the second rod 22.

The locking mechanism includes a lock box 60 that may be fabricated from stainless steel or other suitable material and shaped to form a three sided housing which may be attached to the inside of an enclosure (not shown in this view). The lock box 60 may be mounted on the rear or inside surface of the enclosure by conventional fastening means, such as screws and bosses. The present invention is useful in a variety of applications. Therefore, the lock box 60 may be mounted to the inside of a safe, a locker, a storage container, a vault, or other types of enclosures.

The lock box 60 encloses a solenoid 10 that can be mounted vertically between an upper flange 70 and a lower flange 72 or other fastening means which are secured to the distal wall of the lock box 60. A pawl arm 80 is pivotably mounted on a fixed axis (not shown in this view) which is secured to the base of the lock box 60. The solenoid 10 is positioned in the housing so that the pin 12 of the solenoid 10 may be attached to the frontal portion of the pawl arm 80. A pawl spring 90 is suspended from a third flange 74 which is secured to the distal wall of the lock box 60. One end of the pawl spring 90 is secured to the flange 74. The other end of the pawl spring 90 is secured to the distal portion of the pawl arm 80.

When tumblers are correctly aligned through the proper combination, key, or other unlocking means such as an electronic controller (not shown in this view) a battery, capacitor, or some other electricity source (not shown in this view) energizes the solenoid 10 momentarily. In the embodiment represented by FIG. 1, the battery is external to the locking mechanism and is part of a module that might also include a key pad, a display screen, a smart-card slot, a barcode reader, a light emitting diode, or a scanner linked to a computer database of authorized individuals and their associated unique personal characteristics such as fingerprints or iris patterns.

When the solenoid 10 is energized the pin 12 retracts and lifts the pawl arm 80. The frontal portion of the pawl arm 80 has been fabricated to bend downward so that it engages an aperture 36 in the cam wafer 30 to secure the device. When the pawl arm 80 is lifted it disengages from the aperture 36 in the cam wafer 30. Because of the action of the torsion spring 40 which is coiled with potential energy, when the force of the pawl arm 80 is released from the cam wafer 30, the energy in the torsion spring 40 starts to release which causes the second rod 22 to rotate and the cam wafer 30 to rotate and disengage from the first rod 20. The pawl arm 80 rests upon the upper plane of the cam wafer 30 when the mechanism 100 is unlocked and the door is open to indicate an unlocked state.

Preferably, a microswitch 82 may also be fitted to the lock box. The distal portion of the pawl arm 80 depresses the microswitch 82 when the frontal portion of the pawl arm 80 is lifted. This information may be passed through electronic circuitry (not shown in this view) in a manner well known in the art and may be shown in an optional display panel in a module external to the locking mechanism (not shown in this view) to indicate to the user whether the mechanism is in an unlocked or locked state.

To re-lock the enclosure, the user pushes on the door or lid of the enclosure. The first rod 20 engages the cam wafer 30 and, as the user pushes the door shut, the second rod 22 rotates and the cam wafer 30 rotates. The aperture 36 of the cam wafer 30 rotates to reengage the frontal portion of the pawl arm 80, thereby securing the mechanism.

In the embodiment of FIG. 1, the locking mechanism 100 is made of stainless steel and may be used to lock enclosures of varying materials including but not limited to metal, wood, and plastic. In other embodiments, the locking mechanism may be made of rolled steel, various other metals, composites such as fiberglass, carbon fiber, or plastics. The locking mechanism may also be mounted horizontally in the enclosure, such that the first rod 20 is attached to the door or lid of the enclosure and the second rod 22 is attached to a side of the enclosure.

In still other embodiments, the cam wafer engages 30 directly with a door or lid frame within the enclosure. The locking mechanism in this embodiment thus requires only one rod.

Figure 2A:
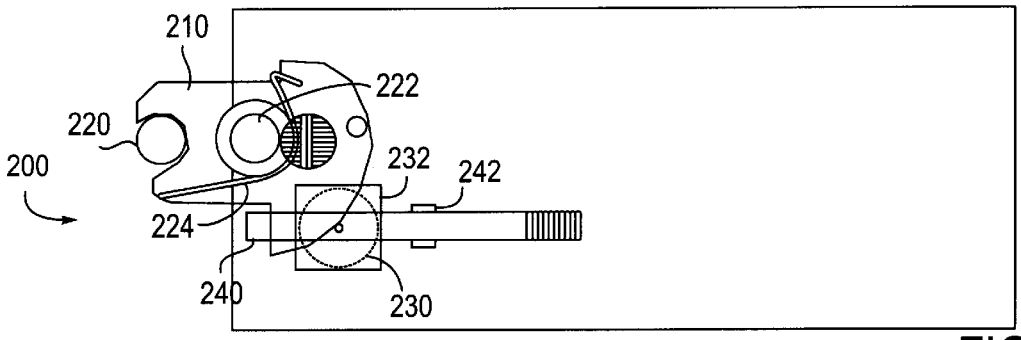
FIG. 2A is a top view of the locking mechanism showing a cam wafer engaged with the first rod as would be the case when the locking mechanism is in the locked state.

FIG. 2A is a top view of the locking mechanism 200 showing the cam wafer 210 engaged with the first rod 220 as would be the case when the locking mechanism 200 is in the locked state. The second rod 222 passes through the thru-hole 224 in the cam wafer 210. In this view, the top plane of the solenoid 230 is shown as it is mounted to the upper flange 232 which is secured to the distal wall of the lock box (not shown in this view). The pawl arm 240 is pivotably mounted on a fixed axis 242 to the base of the lock box (not shown in this view). In the locked state, the pawl arm 240 engages an aperture (not shown in this view) in the cam wafer 210 to secure the locking mechanism.

Figure 2B:
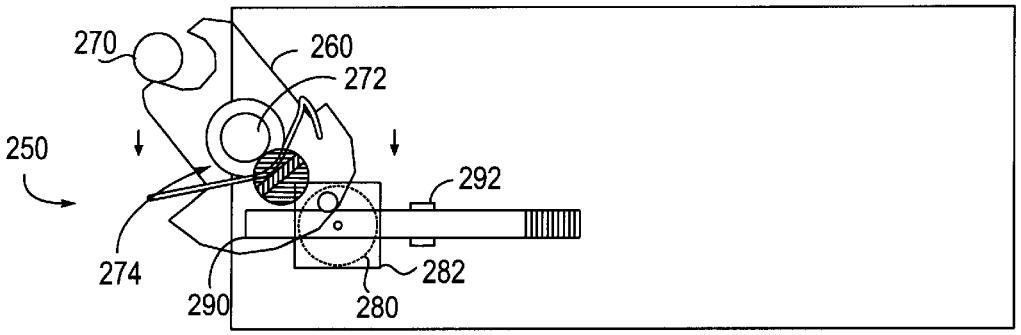
FIG. 2B is a top view of the locking mechanism showing the cam wafer disengaging from the first rod as the locking mechanism is unlocking in accordance with one embodiment of the present invention.

FIG. 2B is a top view of the locking mechanism 250 showing the cam wafer 260 disengaging from the first rod 270 as the locking mechanism 250 is unlocking in accordance with one embodiment of the present invention. The second rod 272 passes through a thru-hole 274 in the cam wafer 260. In this view, the top plane of the solenoid 280 is shown as it is mounted to the upper flange 282 which is secured to the distal wall of the lock box (not shown in this view). The pawl arm 290 is pivotably mounted on a fixed axis 292 to the base of the lock box (not shown in this view) and is in the lifted state and thus disengaged from the aperture (not shown) in the cam wafer 260.

Figure 3:
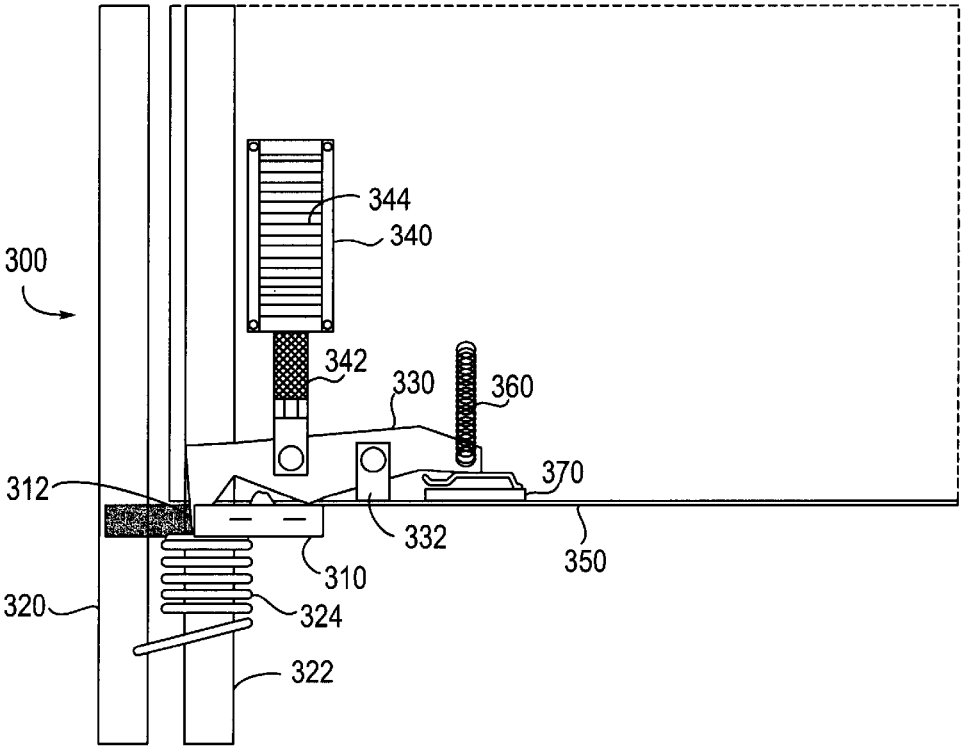
FIG. 3 is a side view of the locking mechanism in the locked position in accordance with an embodiment of the present invention.

FIG. 3 is a side view of the locking mechanism 300 in the locked position in accordance with one embodiment of the present invention. The cam wafer 310 is configured to engage to the first rod 320. The second rod 322 passes through a hole (not shown in this view) in the cam wafer 310. The torsion spring 324 is coiled around the second rod 322 below the cam wafer 310. An alternative embodiment of the pawl arm 330 is disclosed in this view. The solenoid 340 is vertically mounted between two flanges (not shown in this view) secured to the lock box (not shown in this view). A pawl arm 330 is pivotably mounted on a fixed axis 332 at the base of the lock box 350. The solenoid 340 is positioned so that the solenoid pin 342 may be attached to the frontal portion of the pawl arm 330. In the locked position, the solenoid coil 344 remains unenergized and the frontal portion of the pawl arm 330 bends downward and engages an aperture 312 in the cam wafer 310 to secure the device. A pawl spring 360 is suspended from a flange (not shown in this view) which is secured to the distal wall of the lock box (not shown in this view). In this embodiment, a microswitch 370 is fitted to the base of the lock box 350. The microswitch 370 is in the open state and is not depressed by the distal end of the pawl arm 330.

Figure 4:
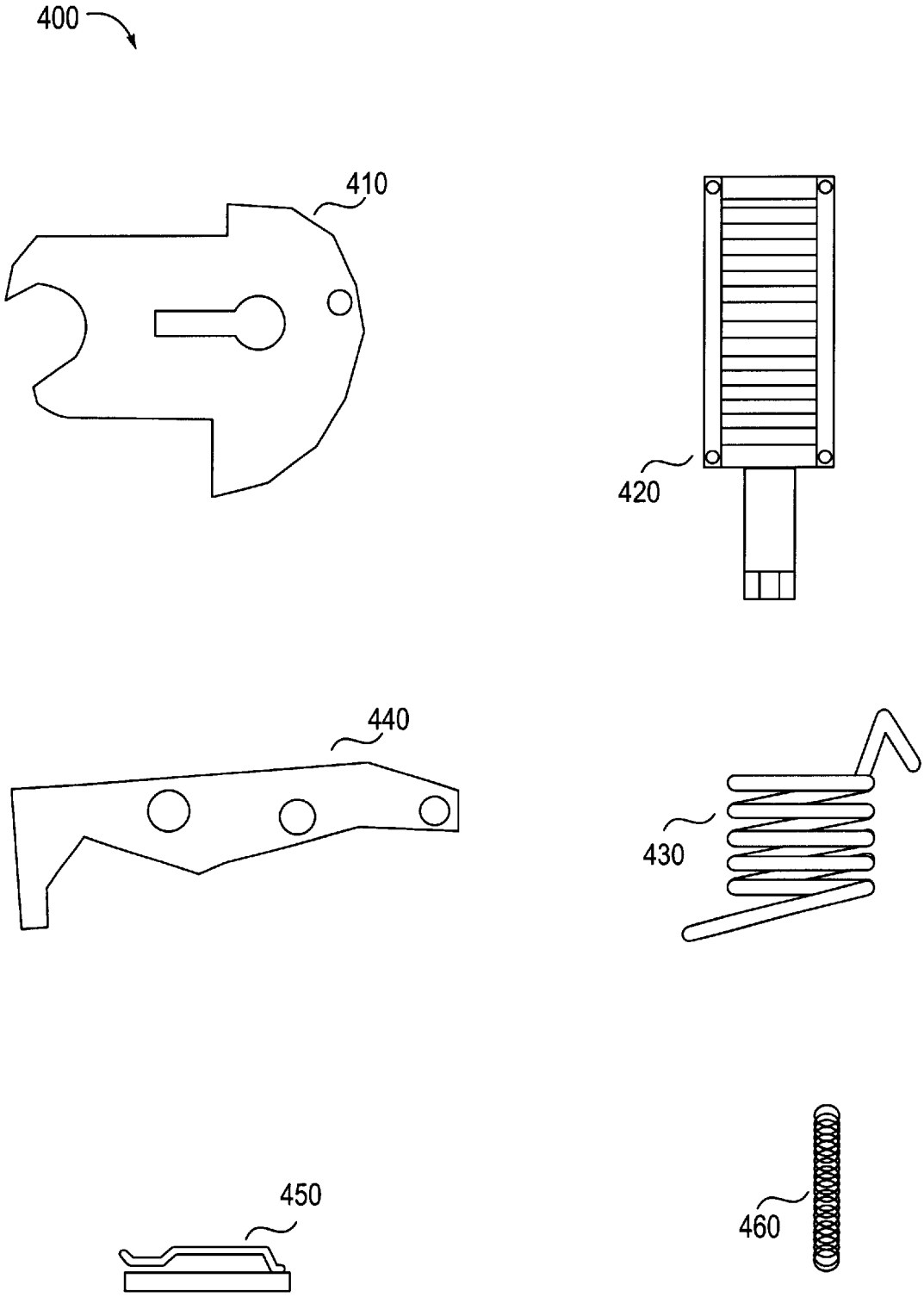
FIG. 4 illustrates various components of the locking mechanism including the cam wafer, the solenoid, the cam spring, the pawl arm, the microswitch and the pawl spring in accordance with an embodiment of the present invention.

FIG. 4 illustrates various components of the locking mechanism including the cam wafer 410, the solenoid 420, the cam spring (or torsion spring) 430, an alternative embodiment of the pawl arm 440, the microswitch 450, and the pawl spring 460.

Figure 5:
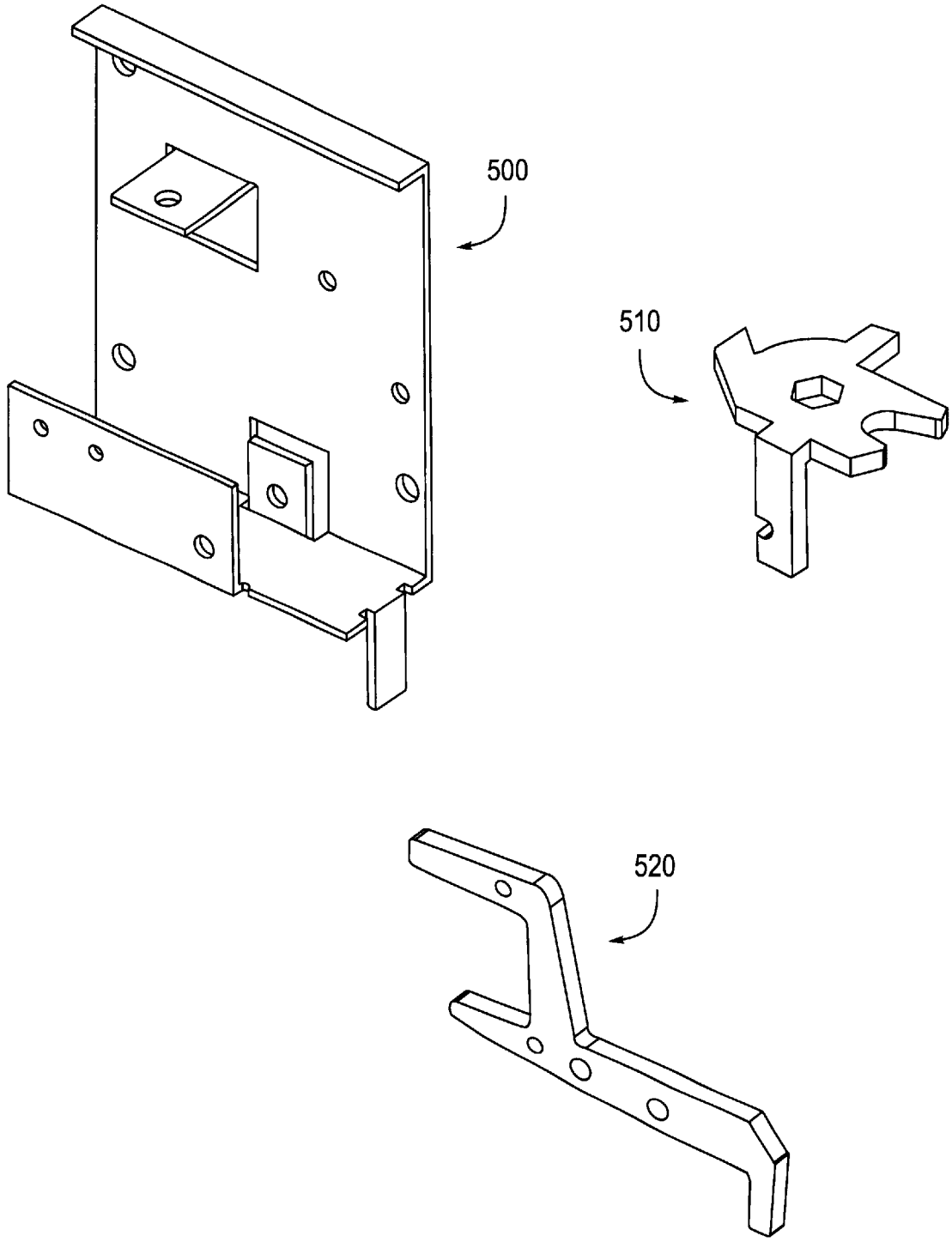
FIG. 5 is a perspective view of the lock box, the cam wafer, and the pawl arm components of the locking mechanism in accordance with an embodiment of the present invention.

FIG. 5 is a perspective view of the lock box 500, the cam wafer 510, and the pawl arm 520 components of the locking mechanism in accordance with an embodiment of the present invention.

Figure 6:
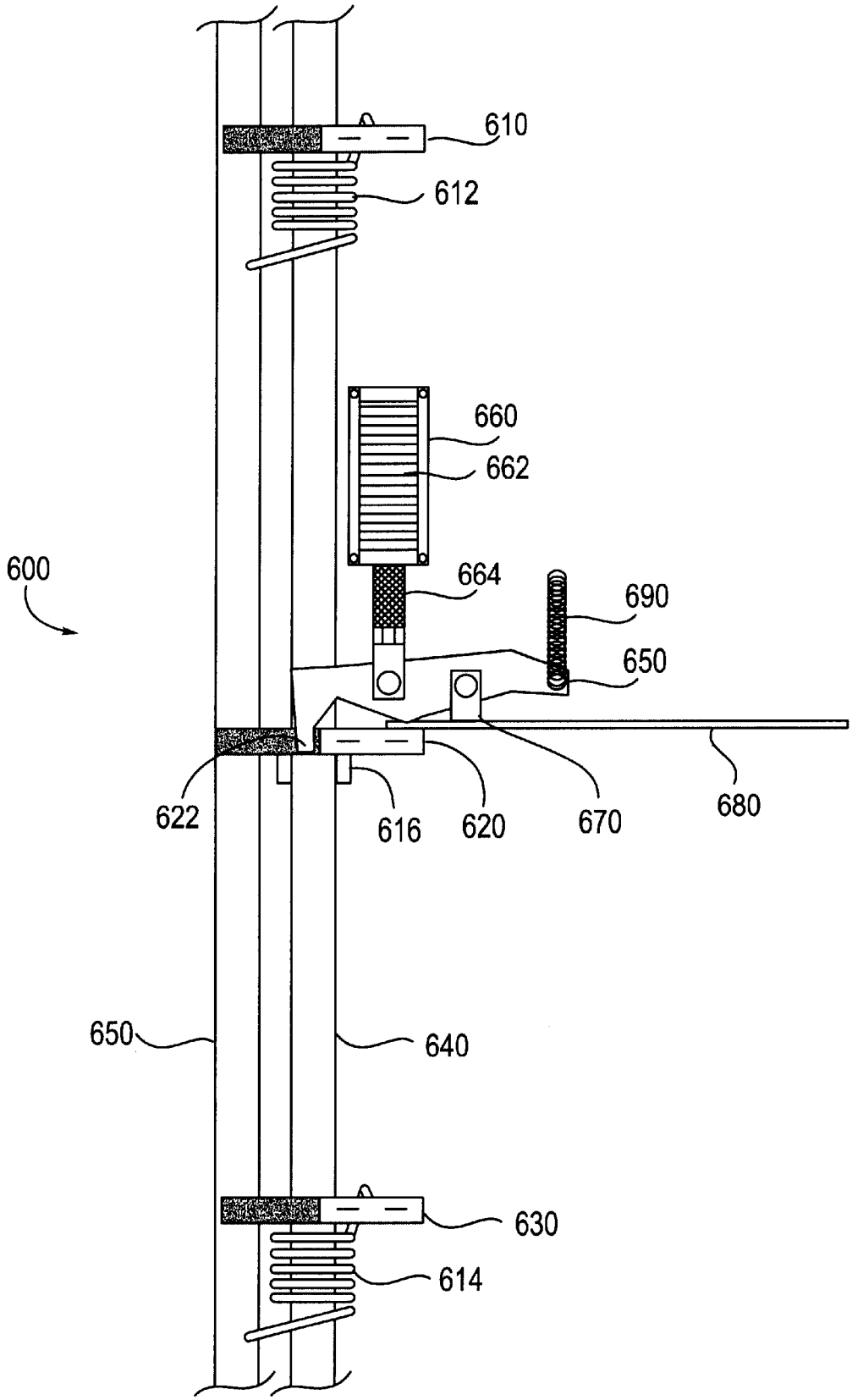
FIG. 6 is a side view of the locking mechanism showing how multiple cam wafers may be added to the second rod as might be needed when locking a large enclosure.

In a further embodiment of the present invention as illustrated by FIG. 6, multiple cam wafers 610, 620, and 630 may be added to the second rod 640 to increase the security of the locking mechanism, such as might be needed to lock a large enclosure. FIG. 6 is a side view of the locking mechanism 600 in the locked state where an upper cam wafer 610 middle cam wafer 620 and bottom cam wafer 630 are secured to the second rod 640. The cam wafers 610, 620 and 630 are configured to engage the first rod 650. The second rod 640 passes through hole (not shown in this view) in the cam wafers 610, 620, and 630. A torsion spring 612 is coiled around the second rod 640 below the upper cam wafer 610 and a torsion spring 614 is coiled around the second rod 640 below the lower cam wafer 630. In this embodiment, an e-clip 616 is secured to the second rod 640 below the middle cam wafer 620. Of course, in another embodiment it would be possible to have a third torsion spring coiled around the second rod 640 at the base of the middle cam wafer 620. An alternative embodiment of the pawl arm 650 is disclosed in this view. The solenoid 660 is vertically mounted between two flanges (not shown in this view) secured to the lock box (not shown in this view). The pawl arm 650 is pivotably mounted to a fixed axis 670 on the lock box base 680. The solenoid 660 is positioned so that the solenoid pin 664 may be attached to the frontal portion of the pawl arm 650. In the locked position, the solenoid coil 662 remains unenergized and the frontal portion of the pawl arm 650 bends downward and engages an aperture 622 in the cam wafer 620 to secure the device. A pawl spring 690 is suspended from a flange (not shown in this view) which is secured to the distal wall of the lock box (not shown in this view). Although in the embodiment of FIG. 6 three cam wafers 610, 620, and 630 are secured to the second rod 640, a plurality of cam wafers may be added to the second rod 640 for additional security. Only one solenoid 660 is necessary to power the locking mechanism, regardless of how many cam wafers 610, 620 and 630 are added to the second rod 640 to increase the strength of the locking mechanism.

An adaptable electronic locking mechanism has thus been described. Although the foregoing description and accompanying figures discuss and illustrate specific embodiments, it should be appreciated that the present invention is to be measured only in terms of the claims that follow.

I claim:

1. A locking mechanism comprising:

a first rod;

a second rod;

a cam wafer attached to the second rod, the cam wafer configured to engage to the first rod; and a locking and unlocking mechanism configured to secure the cam wafer to the first rod and to release the cam wafer from the first rod.

2. The locking mechanism of claim 1 wherein the first rod and second rod each have a cross-sectional shape chosen from the following: round, elliptical, or polygonal.

3. The locking mechanism of claim 1 wherein the first rod is attached to one side of an enclosure.

4. The locking mechanism of claim 1 wherein the second rod is attached to a door or lid of an enclosure.

5. The second rod of claim 4 wherein the rod is manufactured with grooves to accommodate multiple cam wafers.

6. The locking mechanism of claim 1 wherein the locking and unlocking mechanism includes a solenoid and a pawl arm, the solenoid being coupled to the pawl arm, which is configured to engage the cam wafer when the locking mechanism is in a locked state.

7. The locking mechanism of claim 6 wherein the locking and unlocking mechanism further includes a torsion spring coiled around the second rod at the base of the cam wafer and coupled to the cam wafer.

8. The locking mechanism of claim 6 wherein the solenoid is coupled to a power source, such that when the solenoid is actuated the solenoid operates to lift a pawl arm.

9. The locking mechanism of claim 8 wherein when the locking mechanism is in the locked state and the pawl arm is lifted, the second rod and the cam wafer rotate due to the action of the torsion spring and the cam wafer thereby disengages from the first rod.

10. The locking mechanism of claim 9 wherein the pawl arm rests on top of the cam wafer when the locking mechanism is unlocked.

11. The locking mechanism of claim 6 wherein an aperture in the cam wafer allows the cam wafer to engage a frontal portion of the pawl arm and lock the locking mechanism.

12. A locking mechanism comprising:

a rod;

a cam wafer attached to the rod, the cam wafer configured to engage to a locking element mounted in an enclosure; and a locking and unlocking mechanism configured to secure the cam wafer in a locked state when the cam wafer engages the locking element and to release the cam wafer to allow the locking mechanism to open.

13. The locking mechanism of claim 12 wherein the rod has a cross-section selected from the following list: round, elliptical, or polygonal.

14. The locking mechanism of claim 12 wherein the rod includes grooves configured to allow multiple cam wafers to be attached thereto.

15. The locking mechanism of claim 12 wherein the locking and unlocking mechanism includes a solenoid and pawl arm, the solenoid being coupled to the pawl arm which is configured to engage the cam wafer when the locking mechanism is in the locked state.

16. The locking mechanism of claim 15 further including a torsion spring coiled around the rod at a base of the cam wafer.

17. The locking mechanism of claim 15 wherein the solenoid is coupled to a power source, such that when the solenoid is actuate the solenoid operates to lift the pawl arm.

18. The locking mechanism of claim 17 wherein when the locking mechanism is in the locked state and the pawl arm is lifted, the second rod and the cam wafer rotate due to the action of the torsion spring and the cam wafer thereby disengages from the first rod.

* * * * *